US007890039B2

(12) United States Patent
Yamada

(10) Patent No.: US 7,890,039 B2
(45) Date of Patent: Feb. 15, 2011

(54) SHEET SEPARATION DEVICE, SHEET CONVEYANCE APPARATUS, AND IMAGE FORMING SYSTEM

(75) Inventor: Masamichi Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 330 days.

(21) Appl. No.: 12/213,805

(22) Filed: Jun. 25, 2008

(65) Prior Publication Data

US 2009/0003897 A1 Jan. 1, 2009

(30) Foreign Application Priority Data

Jun. 25, 2007 (JP) ..... 2007-166648

(51) Int. Cl.
*G03G 15/20* (2006.01)

(52) U.S. Cl. ..... 399/323

(58) Field of Classification Search ..... 399/398, 399/399, 406, 322, 323; 271/307, 308, 900, 271/311–313
See application file for complete search history.

(56) References Cited

U.S. PATENT DOCUMENTS

| | | | | |
|---|---|---|---|---|
| 4,261,560 | A * | 4/1981 | Yanagawa et al. | 271/900 |
| 4,408,757 | A * | 10/1983 | Yarm | 271/311 |
| 5,138,381 | A * | 8/1992 | Masaki et al. | 399/398 |
| 5,517,292 | A * | 5/1996 | Yajima et al. | 399/323 |
| 5,600,428 | A * | 2/1997 | Yanagida | 399/399 |
| 6,029,038 | A | 2/2000 | Uehara et al. | |
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,865,363 | B2 | 3/2005 | Hachisuka et al. | |
| 6,925,280 | B2 | 8/2005 | Yamada | |
| 7,228,096 | B2 | 6/2007 | Yamada | |
| 2001/0003562 | A1 | 6/2001 | Hachisuka et al. | |
| 2002/0071700 | A1 | 6/2002 | Nishitani et al. | |
| 2003/0053830 | A1 | 3/2003 | Hachisuka et al. | |
| 2003/0215270 | A1 | 11/2003 | Yamada | |
| 2005/0276638 | A1 | 12/2005 | Yamada | |

(Continued)

FOREIGN PATENT DOCUMENTS

| | | |
|---|---|---|
| JP | 62-127781 | 6/1987 |

(Continued)

OTHER PUBLICATIONS

English Language Abstract of JP 64-072182 dated Mar. 17, 1989.

(Continued)

*Primary Examiner*—Susan S Lee
(74) *Attorney, Agent, or Firm*—Harness, Dickey & Pierce, P.L.C.

(57) ABSTRACT

A sheet separation member having a separation pick includes a substrate made of hard material, which is swingable around a support shaft connected to a stable member, and a wrapping member made of resin softer than the substrate for wrapping the substrate. A leading end of the substrate is integrally molded with the wrapping member using inert molding, and a leading end of the wrapping member protrudes from the leading end of the substrate by not more than 5 mm.

6 Claims, 4 Drawing Sheets

U.S. PATENT DOCUMENTS

| | | | |
|---|---|---|---|
| 2006/0045590 | A1 | 3/2006 | Yamada |

FOREIGN PATENT DOCUMENTS

| | | |
|---|---|---|
| JP | 7-86726 | 9/1995 |
| JP | 08-087197 | 4/1996 |
| JP | 2003-029565 | 1/2003 |
| JP | 2003-241557 | 8/2003 |
| JP | 2005-099676 | 4/2005 |
| JP | 2006-011193 | 1/2006 |
| JP | 2006-227349 | 8/2006 |
| JP | 4092329 | 3/2008 |
| JP | 2008-083515 | 4/2008 |

OTHER PUBLICATIONS

English Language Abstract of JP 2006-171551 dated Jun. 29, 2006.
European Search Report dated Aug. 4, 2009 issued in corresponding Application No. EP 08252178.2-1240/2009507.

* cited by examiner

SHEET SEPARATION DEVICE, SHEET CONVEYANCE APPARATUS, AND IMAGE FORMING SYSTEM

CROSS REFERENCE TO RELATED APPLICATION

This application claims priority under 35 USC §119 to Japanese Patent Application No. 2007-166648, filed on Jun. 25, 2007, the entire contents of which are herein incorporated by reference.

BACKGROUND OF THE INVENTION

1. Technical Field

The present invention relates to a fixing device used in an office instrument, such as a laser beam printer, a digital printer, a plain paper facsimile, etc., for fixing a toner image onto a sheet by applying heat, and an image forming apparatus including the fixing device.

2. Discussion of the Background Art

In an image forming apparatus using toner for creating a visible image, a fixing device is generally provided to fix a toner image onto a recording medium such as a transfer sheet, etc., as an eternal image. In this fixing device, when passing through a pressure contact section formed between a fixing roller heated and rotated in a prescribed direction and a pressure applying roller rotated by pressure contacting the fixing roller, toner carried on the recording medium is melt and is fixed onto the recording medium. Since toner mainly including plastic has a characteristic of melting at a pressure applying section and sticking to a fixing roller, the toner is generally prevented from sticking to the fixing roller by one of adding wax component to the toner, wrapping the surface of the fixing roller with material having a mold releasing performance, and coating the surfaces of the fixing roller with mold releasing agent, such as silicone oil or the like. Further, a sheet separation mechanism including a separation pick is provided adjacent to the fixing roller to forcibly separate a sheet winding itself around the fixing roller due to the melting toner.

However, since the separation pick sliding contacts the fixing roller, the toner easily accumulates at a contact section, and sometimes contaminates the recording medium. Further, since the separation pick slides over the fixing roller, a sliding mark is put to the surface of the rotation member, thereby decreasing a life, or causing an abnormal image on the recording medium. Since coating the fixing roller with mold releasing agent, such as silicone oil, etc., is refrained while adding wax component to toner recently, the above-mentioned problem becomes significant. In view of the above, even if a separation pick is necessarily used, a non-offensive performance where material of the separation pick does not damage the fixing roller and a non-sticking performance where toner does not firmly stick to the separation pick are demanded.

Fluorocarbon resin is excellent in these performances as described in Japanese Patent Application Laid Open No. 2003-241557. As describe there, a separation pick is integrally formed and made of the fluorocarbon resin entirely. A supporting shaft attached to the separation pick is also molded and made of the resin. However, fluorocarbon resin is inferior at rigidity. Specifically, when an external force is applied such as when sheet jam occurs, the separation pick deforms and damages the fixing roller, or decreases own sheet separation performance. Further, the fluorocarbon resin largely expands and deforms due to heat in comparison with PPS resin or heat resistant resin such as polyimide. Thus, Fluorocarbon resin can't be employed at a leading end of a separation device expected to have a high positional precision. Further, a strike member is sometimes used to create a gap between a separation plate leading end and a rotation member as described in Japanese Patent Application Laid Open No. 2006-11193. When a separation device does not contact a fixing roller and keeps a gap therebetween, the separation device does not damages the fixing roller, and a problem of contaminating an image due to transfer of toner from the separation device to the fixing roller can be avoided even if some of toner firmly sticks to the separation device.

However, the separation plate is made of plate metal and contacts the fixing roller thereby immediately damaging the fixing roller when sheet jam occurs. Further, the separation plate is pressurized and bent by the jammed sheet. To exert a fixing performance within a small space, a sponge member, such as foam silicone material or the like is increasingly used recently as an elastic member of a fixing roller. As a result, a break-into amount of a pressure applying roller increases and a nip width enlarges.

When a fixing roller made of the foam silicon material is utilized, a start up time is decreased, and power consumption is reduced. In such a fixing unit, the above-mentioned problem becomes significant because a strike member breaks into the fixing roller enriched with elasticity due to an external force caused by the sheet jam. As discussed in the Japanese Patent Application Laid Open No. 07-086726, a separation device positioned downstream of a fixing nip includes a separation pick having a peeling off section formed from a substrate made of polyimide coated with fluorine via a primer layer. A supporting section of the separation pick is made of harder resin and is formed by means of insert molding. The peeling off section has a relatively softer than the supporting section. However, since the substrate of the peeling off section is made of polyimide resin, sliding marks are put onto the fixing roller. Especially, in these days, such a problem is significant in a belt type-fixing device using a foam silicon roller enriched with elasticity almost without silicon oil or the like.

SUMMARY OF THE INVENTION

The present invention has been made in view of the above noted and another problems and one object of the present invention is to provide a new and noble sheet separation device having a separation pick for separating sheets.

Such a new and noble sheet separation member having a separation pick includes a substrate made of hard material, which is swingable around a support shaft connected to a stable member, and a wrapping member made of resin softer than the substrate for wrapping the substrate. A leading end of the substrate is integrally molded with the wrapping member using inert molding, and a leading end of the wrapping member protrudes from the leading end of the substrate by not more than 5 mm.

In another embodiment, a cross section of said wrapping member has a radius of from about 0.2 mm to about 0.05 mm at its leading end.

In yet another embodiment, the resin includes fluorocarbon.

In yet another embodiment, the substrate is made of plate metal and is flattered at its leading end.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
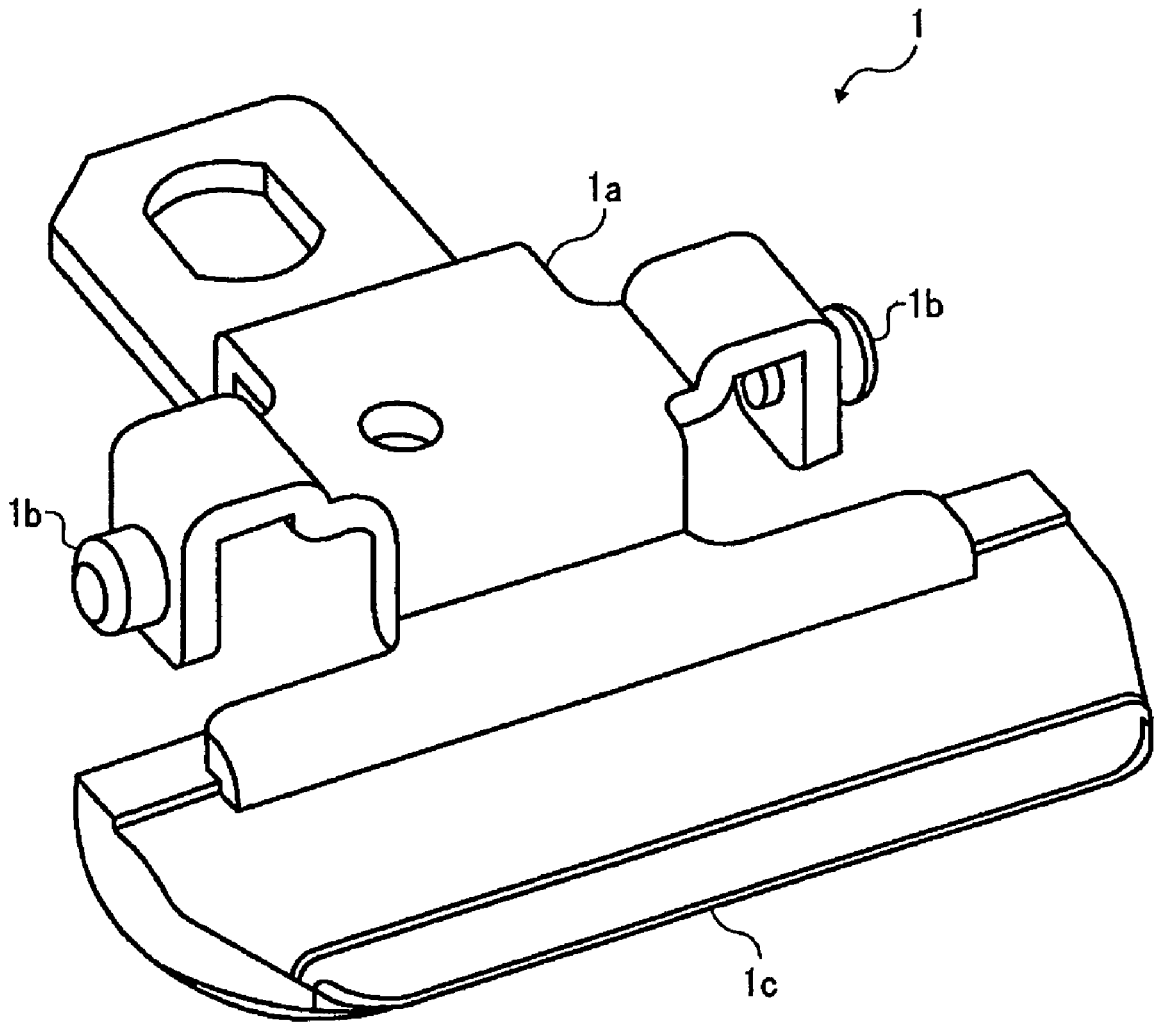
FIG. 1 is a perspective view illustrating an exemplary separation device according to one embodiment of the present invention.

Referring now to the drawings, wherein like reference numerals and marks designate identical or corresponding parts throughout several figures, in particular in FIG. 1, numerals 1, 1*a*, and 1*c* denote a separation member, a substrate, and a separation member head, respectively. As shown the separation member head 1*c* is made of softer resin than the substrate 1*a* and these are integrally molded using an insert molding manner at a tip furthest from a support shaft 1*b* of the substrates 1*a*. Since resin having excellent non-aggression performance capable of avoiding deformation even receiving an external pressure caused by sheet jams is used as the separation member head 1*c*, it does not damage an opponent member. Further, since the substrates 1*a* and the separation member head 1*c* are integrally molded by means of the insert molding, a fine positional precision is obtained between the supporting shaft 1*b* and the separation member head 1*c* when they are molded. Thus, a separation performance is also excellent, because the separation member 1 is molded with the same material.

Figure 2A:
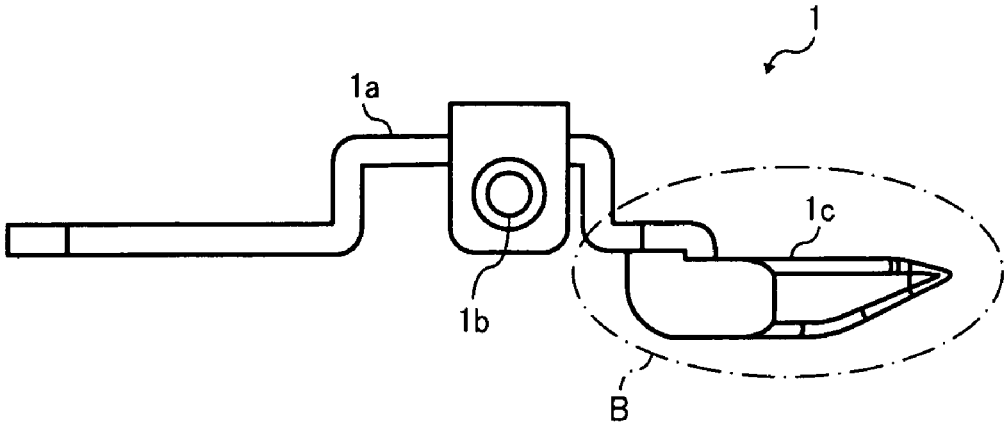
FIGS. 2A and 2B collectively illustrates a sectional view of the separation device of FIG. 1.
Figure 2B:
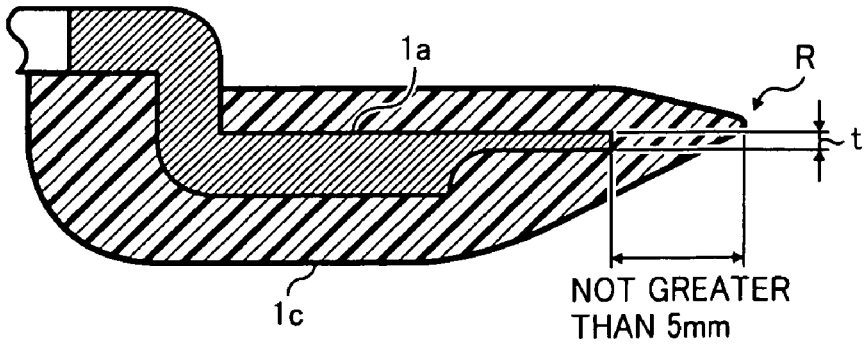

Now, separation member is more specifically described with reference to FIGS. 2A and 2B. As shown in FIG. 2B by a fatty solid line, the separation member head 1*c* forms a pick made of resin integrally molded using the insert molding almost surrounding the tip of the substrates. The tip of the separation member head 1*c* has a radius of about 0.05 to about 0.2 mm at its side ward cross-section. Since the head 1*c* is made of resin different from a metal plate, the head 1*c* can be steeple as shown. The smaller the radius of the sideward cross section of the head 1*c*, the more excellent the separation performance. When the tip has too smaller radius, it damages the opponent member admitting an excellent nonaggression performance of the resin. Thus, the radius is set not less than about 0.005 mm. By setting the tip radius within 0.05 to 0.02 mm, both of the separation and non-aggression performances can consist with each other. As shown in FIG. 2B, a range B of FIG. 2A is partially expanded.

The softer resin of the separation member head 1*c* protrudes from the tip of the substrates 1*a* by not more than 5 mm as shown. With this configuration, even if fluorocarbon resin, which is generally largely expands and deforms due to heat, is used, an absolute amount of such expansion and deformation can be decreased. As a result, the fluorocarbon resin can be practically employed in a separation device expected to have a tip positional precision of about plus or minus 0.1 mm.

The separation member head 1*c* is made of fluorocarbon resin. Since the fluorocarbon resin is excellent in a mold releasing performance, it does not hurt the opponent member even contacting thereof and toner is not firmly fixed thereonto. Thus, by employing the fluorocarbon resin as material of the separation member head 1*c*, the separation member 1 having both of an excellent non-aggressive performance against the opponent member and a non-sticking performance in relation to the toner can be obtained.

Material of the substrates 1*a* can be one of heat resistant and rigidity resin, aluminum die cast, and sintered die cast as far as it is enriched with rigidity. In this example, a shaft is riveted to a metal plate to form the supporting shaft 1*b* for the substrate 1*a*. That is, the plate metal is generally the most cost effective.

As shown in FIG. 2B, the plate metal of the substrate 1*a* has a thickness (t) of about 1 mm and is processed thinner down to about 0.1 to 0.4 mm at its leading end by means of a flattering process. Since the substrate reaches deep inside the separation member head 1*c* owing to this shape, rigidity increases at the leading end of the separation member head 1*c*, and it hardly deforms in response to an external force at the leading end. The supporting shaft 1*b* can be formed on a stable member, and the substrate 1*a* can simply include a hole or a bearing to accept the supporting shaft 1*b*.

Figure 3A:
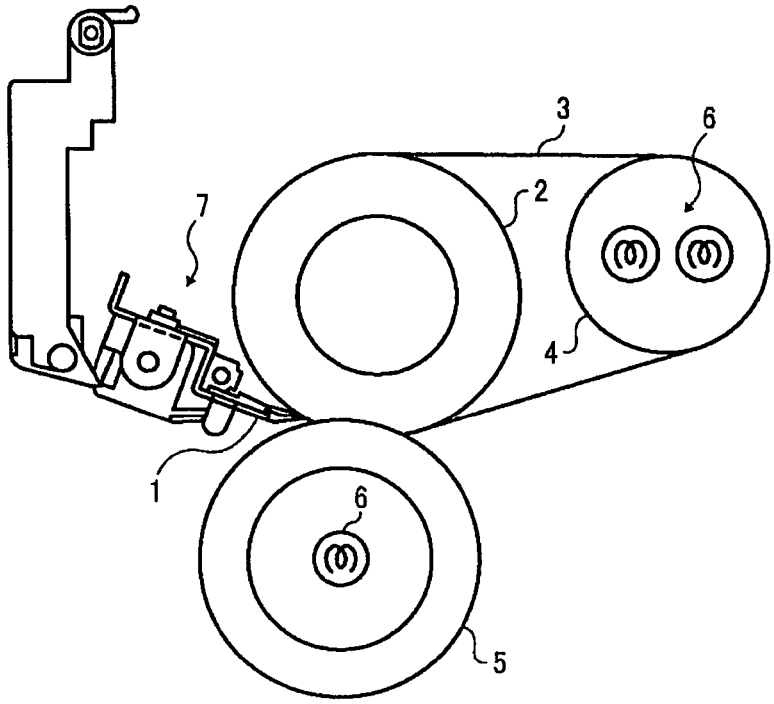
FIGS. 3A and 3B collectively illustrates an exemplary fixing device according to another embodiment of the present invention.
Figure 3B:
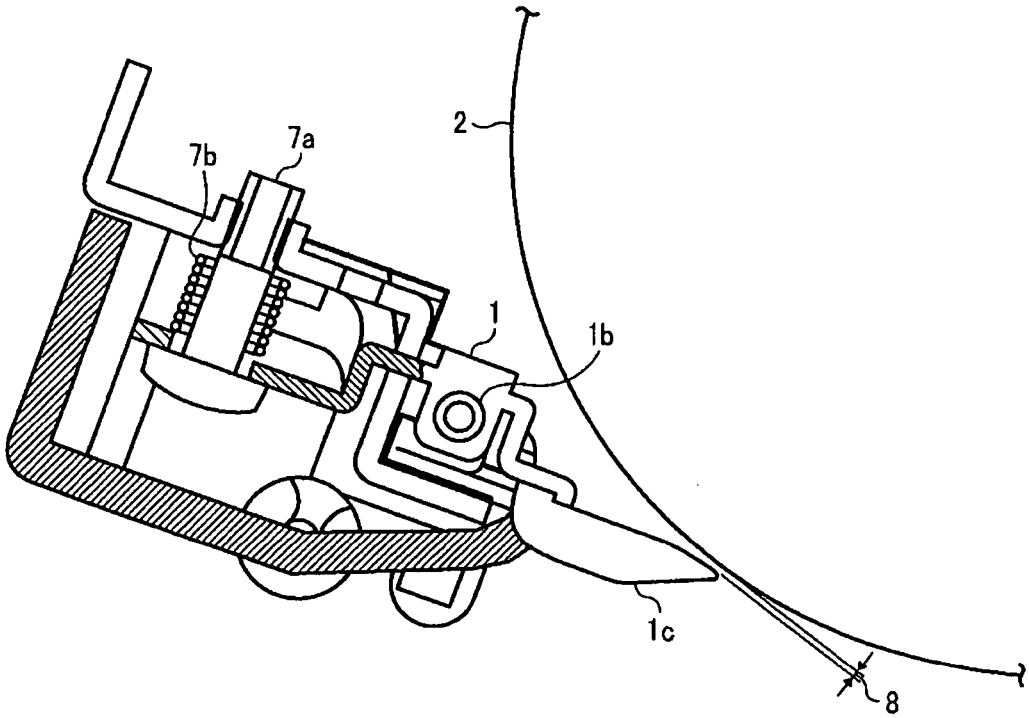

Now, an exemplary fixing device is described with reference to FIGS. 3A and 3B. In the drawing, numerals 2, 3, and 4 denote a fixing roller, a fixing belt, a heat-applying roller, respectively. Numerals 5, 6, 7, and 8 denote a pressure applying roller, a halogen heater, a separation unit, and a gap, respectively. As shown in FIG. 3A, the fixing roller 2 and the heat applying roller 4 are arranged inside the fixing belt 3, and the pressure applying roller 5 forms a nip on the fixing roller 2 via the fixing belt. The halogen heater 6 is included in each of the heat-applying roller 4 and the pressure-applying roller 5. The heat applying roller 4 and the pressure applying roller 5 cooperatively executes fixing while pinching and heating a recording medium conveyed carrying a unfixed toner image from a right side on the drawing.

The fixing belt 3 has an inner radius of 75 mm and includes all of a substrates made of polyimide having a thickness of about 90 micrometer, a layer of silicon rubber having a thickness of about 200 micrometer formed overlying the substrate 1*a*, and a coat layer formed outermost having a thickness of 20 micrometer made of PFA (Tetrafluoroethylene-perfluoroalkylvinyl ether copolymer).

The fixing roller 02 has a diameter of about 52 mm. The heat-applying roller 4 of a hollow cylinder is made of Aluminum having a thickness of 0.6 mm and winds the fixing belt 3. The fixing roller 2 includes a heat resistant and elastic layer made of foam silicon rubber having a diameter of 52 mm and a thickness of 14 mm. The pressure applying roller 5 has a diameter of 50 mm and includes all of a hollow cylindrical core metal made of steel having a thickness of 1 mm, a silicon rubber overlying the core metal, and a PFA (Tetrafluoroethylene-perfluoroalkyl vinyl ether copolymer) tube as the outermost layer.

The pressure-applying roller 5 breaks into the fixing roller 2 via the fixing belt 3 and forms a nip having a width of about 14 mm. The separation member 1 is provided downstream of the nip to separate a transfer sheet from the fixing belt 3. Plural separation members 1 are arranged in a shaft direction of the fixing belt 3. However, the separation member head 1*c* can be a pick shape uniformly formed over the maximum width of the recording medium. The recording medium separated by the separation member 1 is conveyed to a sheet ejection section while being guided by a pair of fixing side and pressure applying side guide plates. The separation member is described more in detail with reference to FIG. 3B. The separation member 1 is freely rotatable around the supporting shaft 1*b*. A position of the separation member head 1*c* is adjustable by means of a compression spring 7*b* and an adjustable screw 7*a* in relation to the fixing belt (i.e., the fixing roller). The adjustable screw 7*a* can enter and exit to and from a screw hole formed on a separation unit 7, which is stable.

By rotation of the adjustable screw 7*a*, the separation member 1 can swing around the supporting shaft 1*b*.

Thus, the gap 8 between the separation member head 1*c* and the fixing belt 3 can range within about 0.1 to 0.6 mm, and a better separation performance can be obtained in the non-contact type separation member 1 more than the contact type separation pick. Since the separation member 1 and the fixing belt 3 can maintain non-contact state, the fixing belt cannot be damaged all the time. Further, fixed toner neither accumulates on the separation member 1 nor is transferred again onto the fixing belt 3 even being accumulated thereon. Further, the separation member 1 does not deform even when sheet jam occurs. Even though the separation member is employed in the fixing device in the above-mentioned example, the separation member 1 or the separation unit 7 can be employed in a transfer apparatus or the like.

Figure 4:
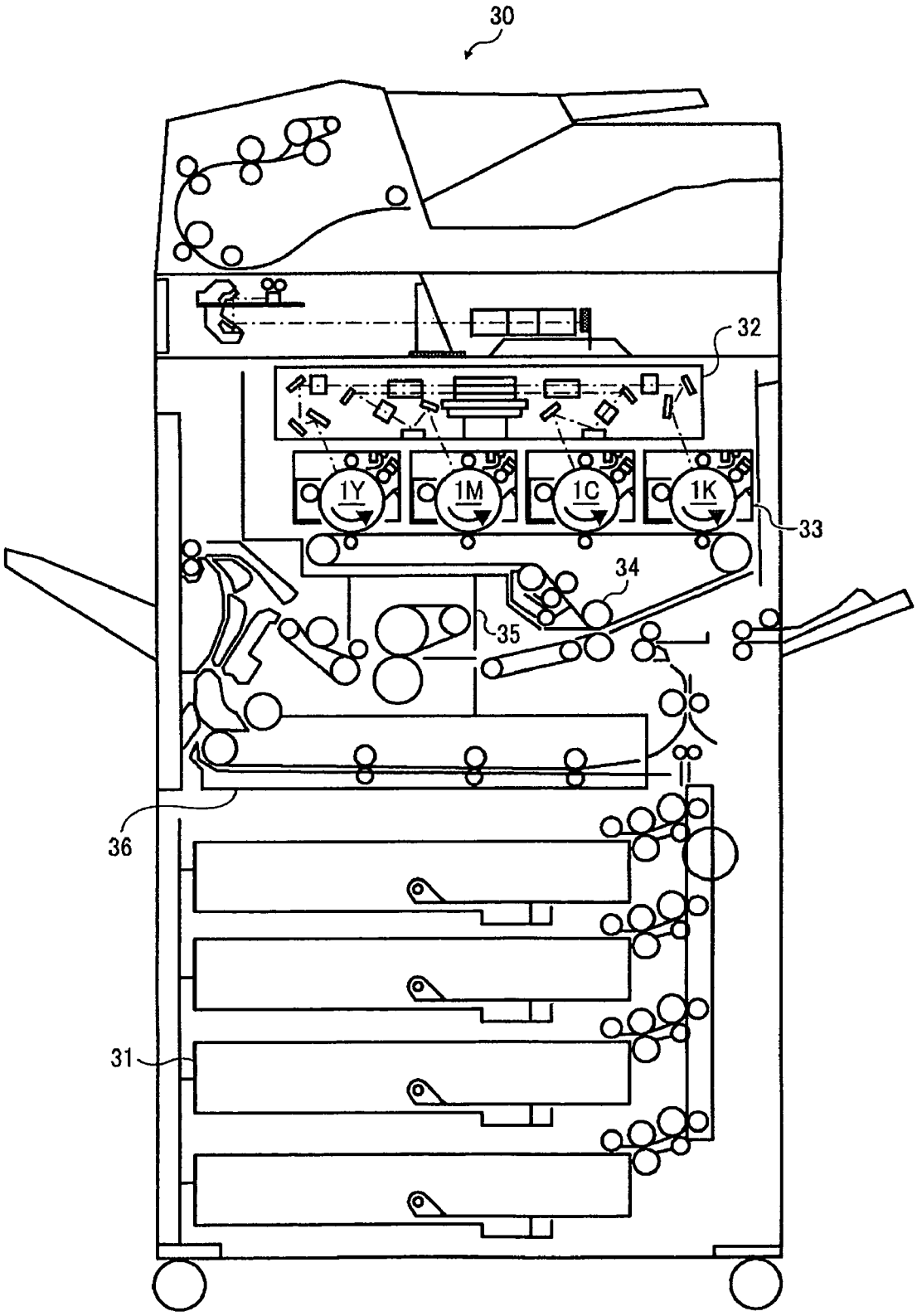
FIG. 4 illustrates an exemplary image forming apparatus including the fixing device according to still another embodiment of the present invention.

An exemplary image forming apparatus including one example of the above-mentioned fixing device is described with reference to FIG. 4. A sheet-feeding unit 31 feeds a sheet to a transfer section. A writing unit 32 executes exposure on a photoconductive member included in an image-forming unit 33 in response to a signal from a scanner or a printer. A latent image formed on the photoconductive member after the exposure process is developed by an image forming unit 33. The developed image is transferred by a transfer unit 34 onto the sheet. A fixing unit 35 fixes a non-fixed toner image. When a duplex mode is executed, a recording medium is inverted by a duplex unit 36 and is conveyed again to a transfer station. The transfer sheet with a fixed toner image is separated by a separation unit 7 and is ejected.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A sheet separation device having a separation pick configured to separate sheets conveyed by a sheet conveyance mechanism, said separation pick comprising:

a substrate made of hard material and swingable around a support shaft connected to a stable member; and a wrapping member made of resin softer than the substrate and configure to wrap the substrate;

wherein a leading end of the substrate is integrally molded with the wrapping member using inert molding, and wherein a leading end of the wrapping member protrudes from the leading end of the substrate by not more than 5 mm.

2. The sheet separation device as claimed in claim 1, wherein a cross section of said wrapping member has a radius of from about 0.2 mm to about 0.05 mm at its leading end.

3. The sheet separation device as claimed in claim 1, wherein said resin includes fluorocarbon.

4. The sheet separation device as claimed in claim 1, wherein said substrate is made of plate metal and is flattered at its leading end.

5. A sheet conveyance apparatus comprising:

a sheet conveyance mechanism configured to convey sheets; and a sheet separation device having a separation pick configured to separate sheets conveyed by a sheet conveyance mechanism, said separation pick including:

a substrate made of hard material and swingable around a support shaft connected to a stable member;

a wrapping member made of resin softer than the substrate and configure to wrap the substrate; and a leading end position adjusting mechanism arranged on the opposite side of the leading end of the separation pick;

wherein a leading end of the substrate is integrally molded with the wrapping member using inert molding and the wrapping member protrudes from the leading end of the substrate by not more than 5 mm;

wherein the leading end of the separation pick is arranged in the vicinity of a sheet passage of the sheet conveyance mechanism, and wherein a gap between the leading end of the separation pick and the sheet passage is adjusted by the leading end position adjusting mechanism.

6. An image forming system including a fixing subsystem configured to fix a toner image onto a sheet, said fixing subsystem including a sheet conveyance apparatus comprising:

a sheet conveyance mechanism configured to convey sheets; and a sheet separation device having a separation pick configured to separate sheets conveyed by a sheet conveyance mechanism, said separation pick including:

a substrate made of hard material and swingable around a support shaft connected to a stable member;

a wrapping member made of resin softer than the substrate and configure to wrap the substrate; and a leading end position adjusting mechanism arranged on the opposite side of the leading end of the separation pick;

wherein a leading end of the substrate is integrally molded with the wrapping member using inert molding and the wrapping member protrudes from the leading end of the substrate by not more than 5 mm;

wherein the leading end of the separation pick is arranged in the vicinity of a sheet passage of the sheet conveyance mechanism, and wherein a gap between the leading end of the separation pick and the sheet passage is adjusted by the leading end position adjusting mechanism.

* * * * *